US006743339B1

(12) United States Patent
Nilsson et al.

(10) Patent No.: US 6,743,339 B1
(45) Date of Patent: Jun. 1, 2004

(54) USE OF A TRANSFER BELT FOR A SOFT TISSUE PAPER MACHINE

(75) Inventors: Göran Nilsson, Oskarström (SE); Bo-Christer Åberg, Halmstad (SE)

(73) Assignee: Albany Nordiskafilt AB, Halmstad (SE)

( * ) Notice: Subject to any disclaimer, the term of this patent is extended or adjusted under 35 U.S.C. 154(b) by 0 days.

(21) Appl. No.: 09/663,333

(22) Filed: Sep. 18, 2000

Related U.S. Application Data

(63) Continuation of application No. PCT/SE99/00434, filed on Mar. 19, 1999.

(30) Foreign Application Priority Data

Mar. 20, 1998 (SE) ..... 9800946

(51) Int. Cl.[7] ..... D21F 7/08
(52) U.S. Cl. ..... 162/358.2; 65/358.4; 65/901
(58) Field of Search ..... 162/306, 358.2, 162/358.4; 65/901

(56) References Cited

U.S. PATENT DOCUMENTS

| | | | |
|---|---|---|---|
| 4,483,745 A | | 11/1984 | Wicks et al. |
| 4,500,588 A | | 2/1985 | Lundstrom |
| 4,529,643 A | | 7/1985 | Lundstrom |
| 4,976,821 A | | 12/1990 | Laapotti |
| 5,002,638 A | | 3/1991 | Gulya et al. |
| 5,298,124 A | | 3/1994 | Eklund et al. |
| 5,393,384 A | | 2/1995 | Steiner et al. |
| 5,556,509 A | * | 9/1996 | Trokhan et al. ..... 162/111 |
| 6,340,413 B1 | * | 1/2002 | Nilsson et al. ..... 162/358.2 |

FOREIGN PATENT DOCUMENTS

| | | |
|---|---|---|
| CA | 1188556 | 6/1985 |
| DE | 195 48 747 A1 | 7/1997 |

* cited by examiner

*Primary Examiner*—Peter Chin
*Assistant Examiner*—Carlos Lopez
(74) *Attorney, Agent, or Firm*—Frommer Lawrence & Haug LLP; Ronald R. Santucci

(57) ABSTRACT

Use of an essentially impermeable transfer belt (16) for a soft tissue paper machine for conducting a soft tissue web (1) through a shoe press nip in the press section of the paper machine, and from the shoe press nip to a Yankee cylinder (5) in the dryer section of the paper machine in a closed draw. The Yankee cylinder forms, together with a transfer means (17), a transfer nip for transferring the soft tissue web from the transfer belt to the Yankee cylinder. The transfer belt comprises a carrier and an elastically compressible polymer layer on its side facing the web, the polymer layer having a hardness between 50 and 97 Shore A and having a web-contacting surface which has a pressure-sensitive, resettable degree of roughness, the web-contacting surface having a degree of roughness in a non-compressed state of $R_z$=2–80 $\mu$m, measured according to ISO 4287, Part I, and a lower degree of roughness of $R_z$=0–20 $\mu$m when the polymer layer is compressed by a linear load of 20–220 kN/m applied to the essentially impermeable transfer belt as measured in a non-extended press nip.

8 Claims, 4 Drawing Sheets

USE OF A TRANSFER BELT FOR A SOFT TISSUE PAPER MACHINE

CROSS REFERENCE TO RELATED APPLICATION

Figure 1:
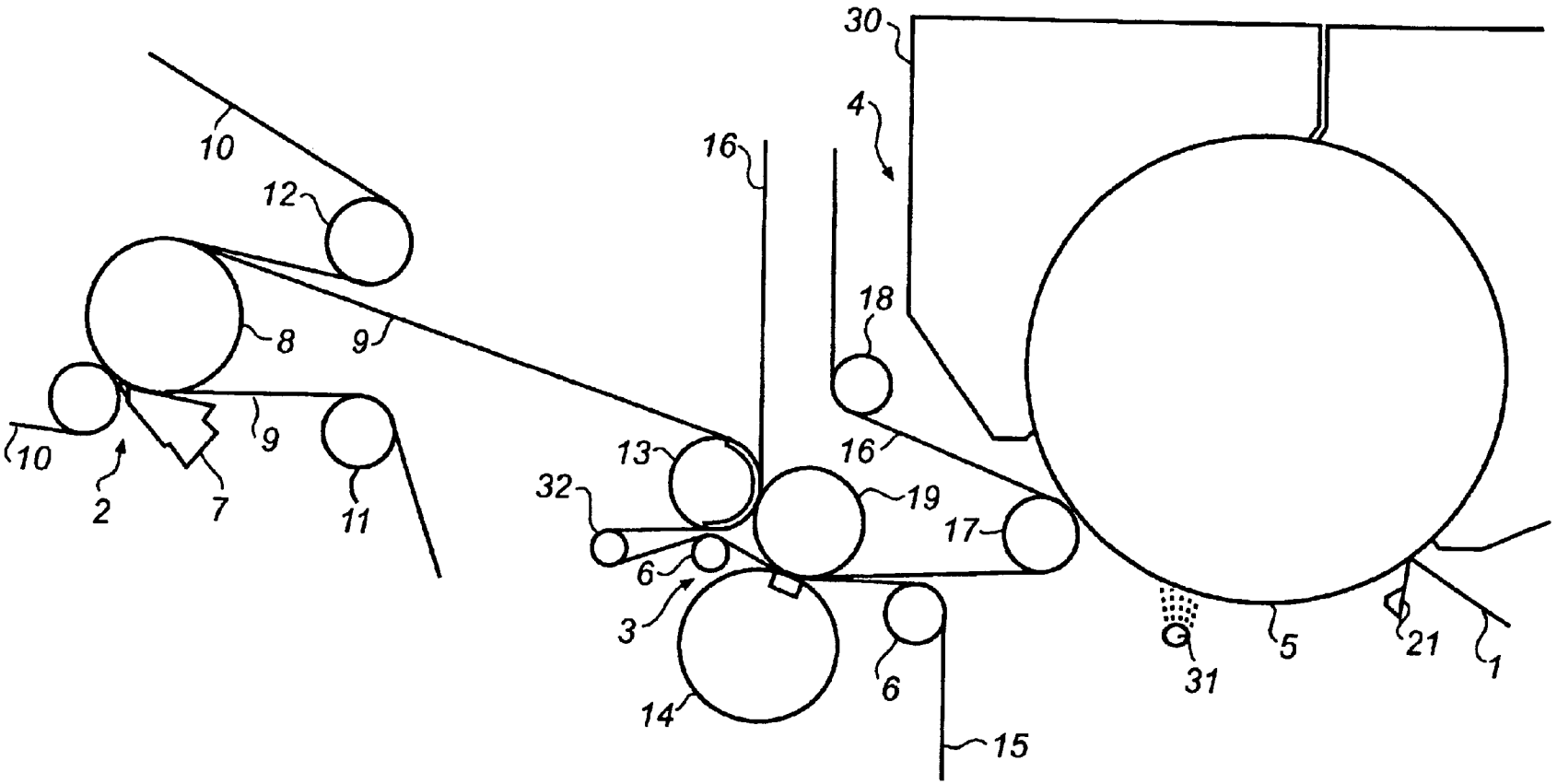

This is a continuation of International Application No. PCT/SE99/00434, which was filed on Mar. 19, 1999 and in which the United States was designated.

The present invention relates to one use of a transfer belt for a soft tissue paper machine.

DE-195 48 747 discloses a paper machine for making creped tissue, which has a press comprising a shoe press roll, a counter roll and a suction roll, the counter roll forming a first press nip with the suction roll and a second extended press nip with the shoe press roll. A felt runs through the two press nips together with the paper web and then brings along the paper web to a Yankee cylinder, to which the paper web is transferred when the felt and the paper web pass round a transfer roll, which forms a non-compressing nip with the Yankee cylinder. Suction zones for dewatering the felt are available before and after the first press nip, the suction zone before the press nip being located inside the suction roll while the suction zone after the press nip is located in a side loop, in which the felt runs alone to meet again the paper web at the entry of the second press nip. Such a paper machine is inconvenient since the paper web is rewet by the wet felt before it reaches the Yankee cylinder.

U.S. Pat. No. 5,393,384 discloses a paper machine for producing a tissue web, which in the embodiment according to FIG. 6 comprises a non-compressible, water-impermeable belt, the underside of which conducts a paper web through a shoe press nip and from there to a Yankee cylinder, via a transfer roll which forms a nip with the Yankee cylinder. This impermeable belt has a smooth web-carrying surface which makes an adhesive water film form thereon as the belt passes through the press nip together with a press felt which has a non-smooth surface in contact with the paper web. As is known, a Yankee cylinder has a smooth surface. Since both the Yankee cylinder and the impermeable belt have smooth surfaces which the paper web is intended to contact, there is a risk that the paper web continues to adhere to the smooth surface of the impermeable belt after having passed the nip adjacent to the Yankee cylinder instead of being transferred, as desired, to the smooth surface of the dryer cylinder. Not even if large amounts of adhesive are applied to the circumferential surface of the dryer cylinder will it be possible to ensure that the paper web adhere to the Yankee cylinder.

The invention starts from the technique described above and its object is to provide a transfer belt, by means of which the soft tissue web can be transferred to a Yankee cylinder in a reliable or more reliable manner.

U.S. Pat. No. 5,298,124 produces an excellent presentation of the tasks which a transfer belt in corporation with a press felt should perform in a satisfactory manner, as well as the properties and construction of such transfer belts which were then disclosed in U.S. Pat. Nos. 4,483,745; 4,976,821; 4,500,586; 5,002,638; 4,529,643 and CA-A-1,188,556.

The critical tasks, according to U.S. Pat. No. 5,298,124, of a transfer belt intended for cooperation with a press fabric comprise a) removing the paper wet from the press fabric without causing instability problems; b) cooperating with the press fabric in one or more nips to ensure optimal dewatering and a high quality of the paper web; and c) transferring the paper web in a closed draw from a press in the press section to a paper-receiving wire or belt in the subsequent press (presses) in the press section, or to a pick-up wire in the dryer section.

U.S. Pat. No. 5,298,124 suggests a transfer belt for the press section in a paper machine having a specific design, and such a transfer belt is shown and described for operation in three paper machines with different press sections, which all comprise a shoe press nip, the belt transferring the paper web from the press section to a dryer fabric which brings the transferred web to a dryer cylinder.

The transfer belt disclosed in U.S. Pat. No. 5,298,124 for the press section of a paper machine has a web-contacting surface which is essentially impermeable to water and air and which has a pressure-responsive microscale topography. Under the action of the pressure in a press nip of the press section, the transfer belt is compressed such that the microscale roughness of said surface decreases, making the surface much smoother and allowing a thin, continuous film of water to be built up between the paper web and said surface. The thin, continuous film of water provides much stronger adhesive forces between the paper web and the transfer belt than between the paper web and the press fabric, so that the paper web may reliably follow the transfer belt as the paper web leaves the press nip. In this connection, the transfer belt expands in the direction of thickness and approaches its non-compressed state such that the film of liquid on said web-contacting surface breaks up.

According to the invention, it has surprisingly been found that a belt of the type according to U.S. Pat. No. 5,298,124 is well suited also for the transfer of a soft tissue web in a closed draw from a shoe press nip in the press section to a Yankee cylinder in a the dryer section of a soft tissue paper machine. As is known, a shoe press nip results in a great degree of dewatering.

The essentially impermeable and elastically compressible transfer belt according to the invention thus consists of an endless carrier, alternatively comprising a joinable seam, with a polymer coating on its web-contacting surface having a hardness of 50–97 Shore A, the polymer coating having a non-compressed degree of roughness of $R_z$=2–80 $\mu$m, measured according to ISO 4287, Part I, and is compressible to a lower degree of roughness of $R_z$=0–20 $\mu$m when a linear load of 20–200 kN/m is applied to the essentially impermeable belt and is capable of being reset to its non-compressed degree of roughness when the pressure acting on the essentially impermeable belt ceases. The $R_z$ value is the ten point height that in said ISO standard is defined as the average distance between the five highest crests and the five deepest troughs of the reference length measured from a line which is parallel to the centre line and does not intersect the surface profile. Preferably the essentially impermeable transfer belt has an air permeability of less than 6 $m^3/m^2/min$ measured according to "Standard Test Method for Air Permeability of Testing Fabrics, ASTM D 737-75, American Society of Testing and Materials".

It is surprising that such a transfer belt, which according to U.S. Pat. No. 5,298,124 is intended for pressing in a press section and usable for transfer of a paper web from the press section to a dryer fabric, is usable in a very advantageous manner to transfer a soft tissue web from a shoe press nip directly to a Yankee cylinder. In a Yankee cylinder, the conditions are, in fact and as is known, quite different from those in a press nip. In a Yankee cylinder, there is no pressing of the soft tissue web for direct dewatering, but it is instead a matter of supporting the soft tissue web against the outer surface of the Yankee cylinder, such that the fibres of the soft tissue web adhere to the surface of the Yankee cylinder in order to get stuck by burning, thereby obtaining good thermal transmission to the paper web. Precisely this effect is achieved by the inventive transfer belt, which cannot be achieved by a press felt according to DE 195 48 747 owing to the above-mentioned rewetting of the paper web after the last press nip in the press section, which prevents good adhesion, and cannot be achieved or is achieved to a substantially smaller extent by a transfer belt according to U.S. Pat. No. 5,393,384, for the reason described above. The compressibility of the inventive transfer belt results in a lower specific pressure in the adhesion point, which in turn entails increased runnability, i.e. a higher production rate. Moreover, this property causes an increased evaporation of water from the soft tissue web, i.e. quicker drying of the soft tissue web on the Yankee cylinder, which also contributes to a higher efficiency of the process. The increased efficiency can be used either as a higher machine speed or as a reduced consumption of energy while retaining the production volume.

Figure 2:
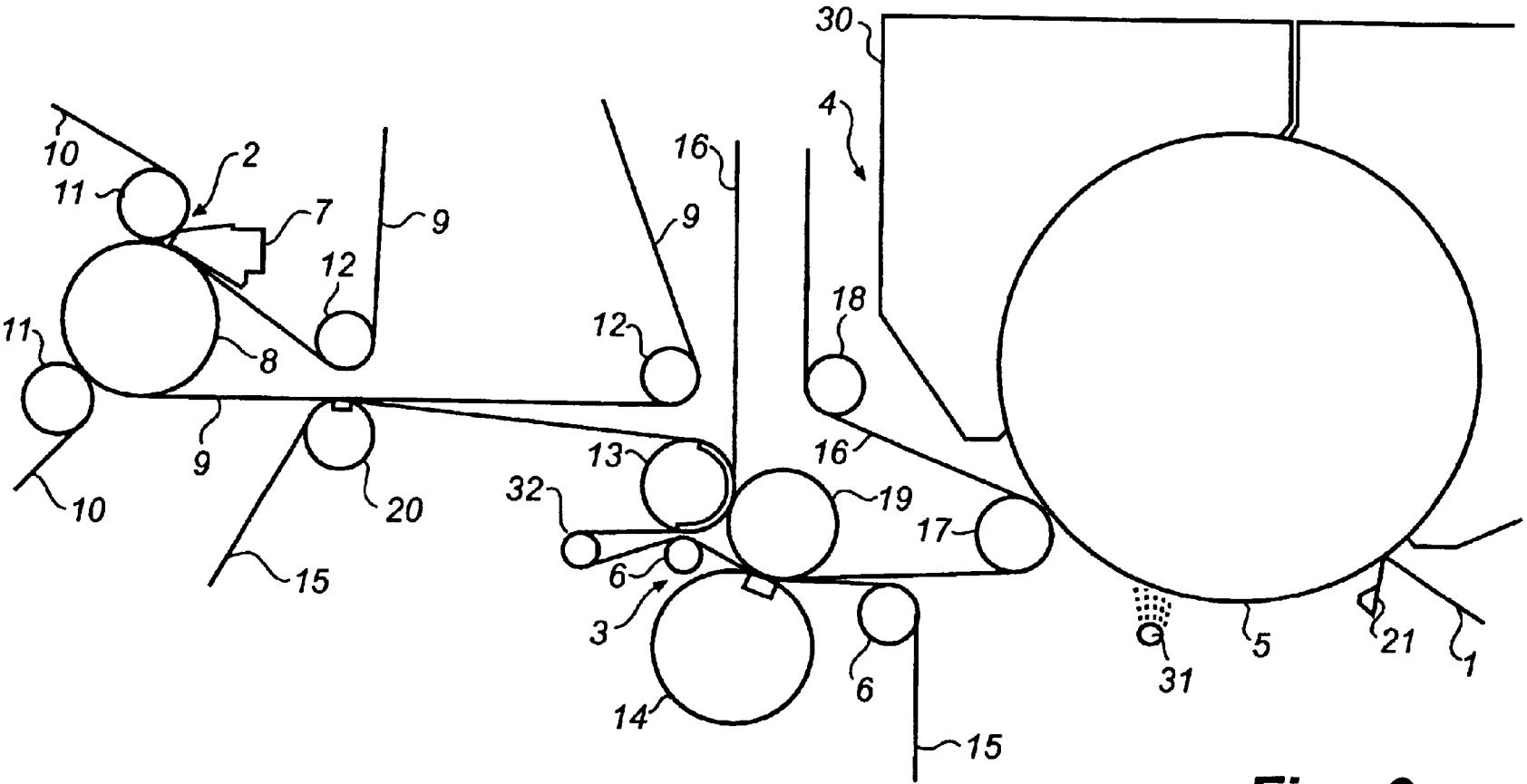
Figure 3:
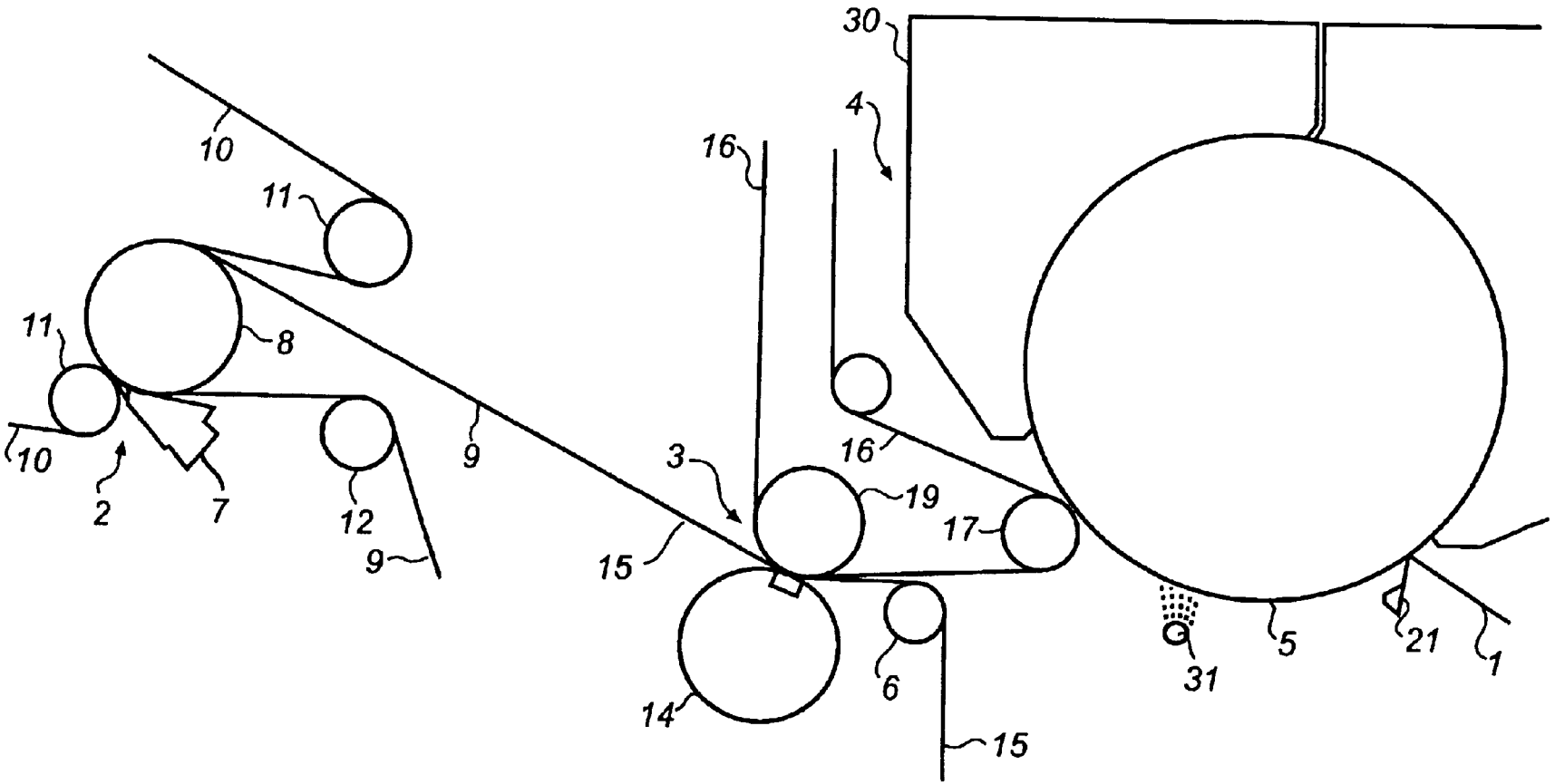
Figure 4:
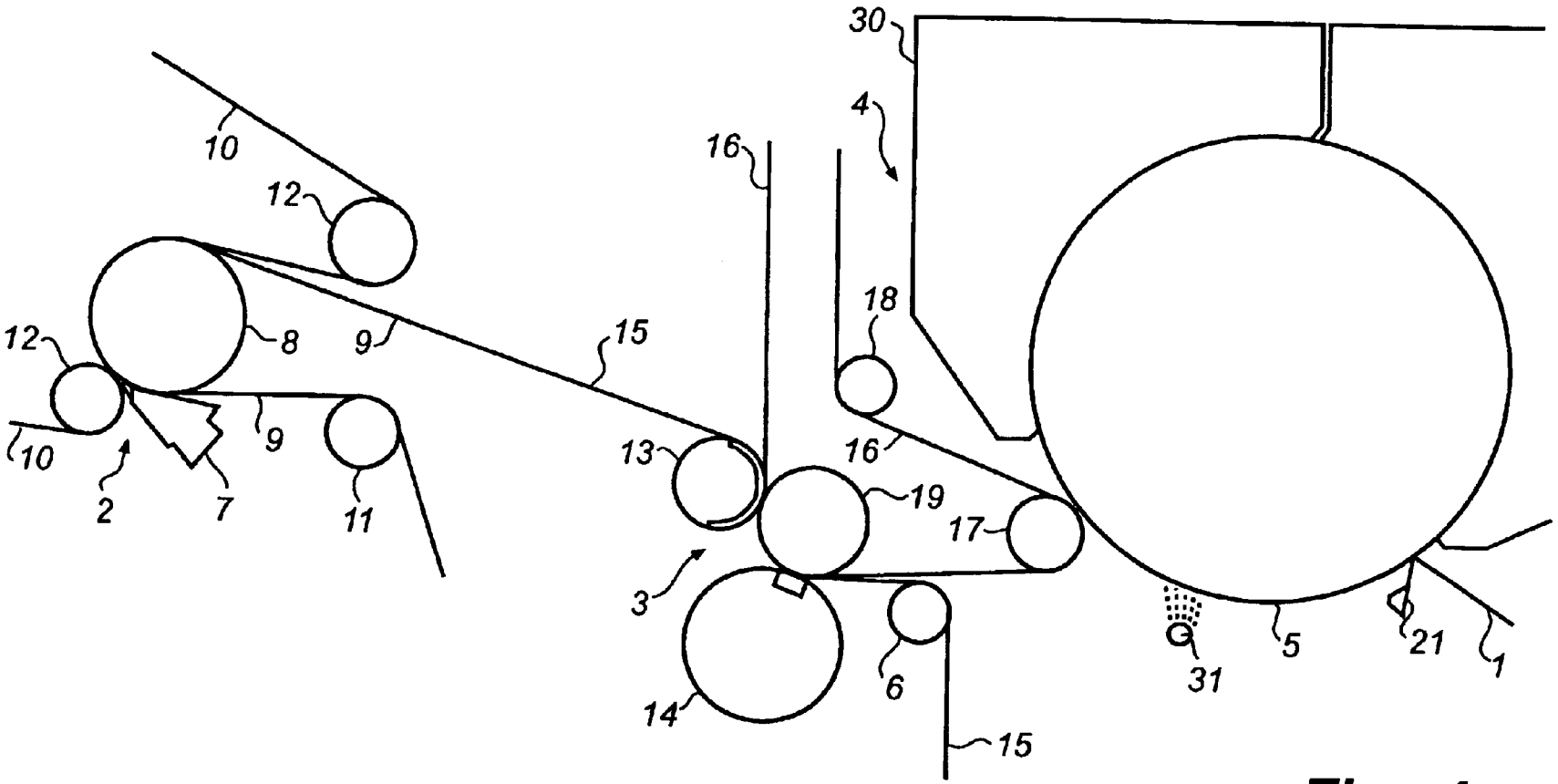

The invention will now be described in more detail with reference to the accompanying drawings, in which FIG. 1 shows a paper machine with a transfer belt according to the invention, FIG. 2 shows another paper machine with a transfer belt according to the invention, FIG. 3 shows one more paper machine with a transfer belt according to the invention, and FIG. 4 shows a further paper machine with a transfer belt according to the invention.

FIGS. 1–4 are schematic views of parts of paper machines for making a fibrous web 1 of soft tissue paper, such as sanitary paper products. Each of the paper machines comprises a wet section 2, a press section 3 and a dryer section 4.

The wet section 2 comprises a head box 7, a forming roll 8, an endless, carrying inner clothing 9 and an endless, covering outer clothing 10, which consists of a forming fabric. The inner and outer clothings 9, 10 each run in a loop round a plurality of guide rolls 11, 12.

The dryer section 4 comprises a Yankee type dryer cylinder 5 which is covered with a hood 30. At the exit size of the dryer section there is a crepe doctor 21 which is adapted to crepe off the fibrous web 1 from the Yankee cylinder 5. Moreover there is an application means 31 or applying a suitable adhesive to the circumferential surface of the Yankee cylinder 5 just before the transfer nip.

The press section 3 comprises a shoe press having a shoe press roll 14 and a counter roll 19, said rolls 14, 19 forming an extended press nip with each other. Moreover the press section comprises an endless press fabric 15 which runs in a loop round the guide rolls 6, and an endless, essentially impermeable transfer belt 16. The essentially impermeable belt 16 runs in a loop round the counter roll 19, a transfer roll 17 and a plurality of guide rolls 18.

The transfer roll 17 forms with the Yankee cylinder 5 a transfer nip with a low linear load, through which transfer nip thus runs the essentially impermeable belt 16.

In the embodiments shown in FIGS. 1 and 2, the press section 3 also comprises a press, the rolls of which consist of a suction press roll 13 and said counter roll 19 to form, a press nip, through which the essentially impermeable belt 16 and the press fabric 16 run together with the fibrous web 1. After this initial press nip, the press fabric 15 is conducted away from the fibrous web 1 and the essentially permeable belt 16 in a side loop round the suction press roll 13 and two guide rolls 32. The press fabric 15 then again unites with the fibrous web 1 and the essentially impermeable belt 16 just before the extended press nip. If desired, suction means can be arranged in this side loop of the press fabric 15 in order to increase the water-absorbing capacity of the press fabric at the entry of the extended press nip.

In the embodiments shown in FIGS. 1 and 3, the inner clothing 9 of the wet section 2 is a fabric which is conducted to the press section 3 to be used also as a press fabric 15, and which thus in a loop runs back to the forming roll 8.

In the embodiment shown in FIG. 2, the inner clothing 9 of the wet section 2 is a fabric, the press fabric 15 running round a pick-up roll 20 which is arranged close to the loop of the fabric 9, such that the press fabric 15 and the fabric 9 run in contact with each other to transfer the fibrous web from the fabric 9 to the press fabric 15. The pick-up roll 20 can be provided with a suction shoe (not shown). Alternatively, the pick-up roll with suction shoe can be replaced by a pick-up suction box.

FIG. 4 is a schematic view of parts of a paper machine according to a further embodiment of the invention, which is similar to the one shown in FIG. 1 except that the press fabric 15 in this case is not conducted in a side loop between the two press nips, but instead follows the counter roll 19, such that he fibrous web 1 is kept enclosed between the essentially impermeable belt 16 and the press fabric 15. This embodiment can be used when there is a small risk of resetting of the fibrous web.

In the embodiments according to FIGS. 1–4, the counter roll 19 is a smooth roll and is arranged in the loop of the essentially impermeable belt 16. In an alternative embodiment (not shown) of the cress section according to FIG. 3, the positions of the rolls 14, 19 are inversed, i.e. the shoe press roll 14 is arranged in the loop of the essentially impermeable belt 16 and the counter roll 19 in the loop of the press fabric 15. In such a configuration, the counter roll can be a suction roll, a grooved roll or a blind bore roll.

The polymer coating or the essentially impermeable transfer belt can, as stated in U.S. Pat. No. 5,298,124, advantageously comprise a polymer composition, such as acryl polymer resin, polyurethane polymer resin and polyurethane/polycarbonate polymer resin composition. The polymer coating can also comprise a particulate filler, which has a hardness different from that of the polymer material and which can be, for instance, kaolin clay, polymer material or metal, preferably stainless steel.

It is possible to produce the inventive transfer belt in the way which is also disclosed in U.S. Pat. No. 5,298,124.

By using the above components, the belt is provided with a surface layer which is elastically compressible. After the actual surface treatment in the production process, a surface is obtained, which results in a controlled topography. The compressibility and topography of the surface layer are not affected to any considerable extent by the possible wear that may arise in operation.

The tight polymer surface is easy to keep clean and withstands cleaning by means of a doctor blade directly on the belt surface. For the belt not to age in the edge portions running against the Yankee cylinder outside the paper web, this must be taken into consideration when selecting materials, and the combinations should be selected which have optimal temperature stability. Otherwise, it is necessary to introduce edge cooling, for instance, by spraying water or, the edge just before or after passing the Yankee cylinder.

The carrier of the transfer belt is endless and comprises all types of base elements that are in some way made endless.

The expression comprises specifically also an openable seamed base element, which is made endless only when being installed in the paper machine by means of a suitable seam. The carrier may consist of, for instance, a multilayered woven fabric made of polymer monofilament yarn such as polyester, polyamide and the like. The base element can also consist of fibrous web (nonwoven) kept together by a binder, joined wound threads, polymer foil/film, warp knit or the like.

The carrier must be dimensionally stable both in the machine direction and in the cross-direction, thereby contributing to the stability of the belt when subjected to mechanical stress in these directions.

If the carrier is desired to be completely enclosed in the polymer coating, it can either be applied to one side with complete bleeding-through to the rear side or be applied first to one side and then to the other.

There may be other configurations in which especially thin belts are desired, and it may then be suitable to apply the coating from one side only, in which case the bleeding-through is limited. It is then essential that the non-coated surface of the base element is resistant to wear and easy to keep clean.

A paper machine with a transfer belt according to the invention and whose press nip/press nips is/are single-felted, produces a fibrous web which before the Yankee cylinder has a high dry solids content, i.e. up to 55%, which is to be compared with the dry solids contents of up to 45% which are achieved in paper machines that are currently used in practice. This improvement can be used either to operate the paper machine with a higher production rate as mentioned above, or to reduce the consumption of energy in the dryer section, in which case there is also a possibility of reducing the diameter of the Yankee cylinder.

In the embodiments described and shown above, a guide roll can, if desired, be arranged in the loop of the essentially impermeable belt 16 just before the transfer roll 17.

In the embodiments described and shown above, use is made of a transfer means which consists of the transfer roll 17. According to an alternative embodiment (not shown), the transfer roll is replaced by the essentially impermeable belt itself, which is allowed to run round a predetermined part of the Yankee cylinder, for instance in a sector angle of 30–60°, with a view to forming an extended transfer nip with the dryer cylinder.

The inventive transfer belt can have a pattern on its side facing the paper web, thereby producing an embossed soft tissue web.

What is claimed is:

1. In a soft tissue paper machine having an essentially impermeable transfer belt for conducting a soft tissue web through a shoe press nip in the press section of the paper machine, and from the shoe press nip directly to a Yankee cylinder in the dryer section of the paper machine in a closed draw, which Yankee cylinder forms, together with a transfer means, a transfer nip transferring the soft tissue web from the transfer belt to the Yankee cylinder, the improvement comprising an essentially impermeable transfer belt having a carrier and an elastically compressible polymer layer on its side facing the paper web, the polymer layer having a hardness between 50 and 97 Shore A and having a web-contacting surface which has a pressure-sensitive resettable degree of roughness, the web-contacting surface having a degree of roughness in a non-compressed state of Rz=2–80*m, measured according to ISO 4287, Part I, and a lower degree of roughness of Rz=0–20*m when the polymer layer is compressed by a linear load of 20–220 kN/m applied to the essentially impermeable transfer belt as measured in a non-extended press nip, wherein the transfer of said soft tissue web from said shoe press nip directly to the Yankee cylinder is improved due to said transfer belt's web-contacting surface having a pressure-sensitive resettable degree of roughness.

2. An improvement as claimed in claim 1, wherein the essentially impermeable transfer belt has an air permeability of less than 6 m3/m2/min, measured according to the method stated in "Standard Test Method for Air Permeability of Textile Fabrics, ASTM D 737-75, American Society of Testing and Materials".

3. An improvement as claimed in claim 1, wherein the polymer layer comprises a polymer composition taken from the group consisting of acryl polymer resin, polyurethane polymer resin and polyurethane/polycarbonate polymer resin composition.

4. An improvement as claimed in claim 1, wherein the polymer layer comprises a particulate filler which has a hardness different from that of the polymer composition, and is taken from the group consisting of kaolin clay, polymer material or metal.

5. An improvement as claimed in claim 1, wherein the polymer layer completely encloses the carrier.

6. An improvement as claimed in claim 1, wherein the carrier is endless.

7. An improvement as claimed in claim 1, together with a transfer which comprises the transfer belt itself, which runs round a predetermined part of the Yankee cylinder to form an extended transfer nip.

8. In a soft tissue paper machine having an essentially impermeable transfer belt for conducting a soft tissue web through a shoe press nip in the press section of the paper machine, and from the shoe press nip to a Yankee cylinder in the dryer section of the paper machine in a closed draw, which Yankee cylinder forms, together with a transfer means, a transfer nip transferring the soft tissue web from the transfer belt to the Yankee cylinder, the improvement comprising an essentially impermeable transfer belt having a carrier and an elastically compressible polymer layer on its side facing the paper web, the polymer layer having a hardness between 50 and 97 Shore A and having a web-contacting surface which has a pressure-sensitive resettable degree of roughness, the web-contacting surface having a degree of roughness in a non-compressed state of Rz=2–80*m, measured according to ISO 4287, Part I, and a lower degree of roughness of Rz=0–20*m when the polymer layer is compressed by a linear load of 20–220 kN/m applied to the essentially impermeable transfer belt as measured in a non-extended press nip, wherein the transfer of said soft tissue web from said shoe press nip to the Yankee cylinder is improved due to said transfer belt's web-contacting surface having a pressure-sensitive resettable degree of roughness, and wherein the polymer layer is embossed to produce embossed soft tissue.

* * * * *